US008376033B2

(12) United States Patent
Robidou et al.

(10) Patent No.: US 8,376,033 B2
(45) Date of Patent: Feb. 19, 2013

(54) HEAT EXCHANGER COMPRISING TUBES WITH GROOVED FINS

(75) Inventors: Herveline Robidou, Carquefou (FR); Jerome Goumondie, Getigne (FR); Remy Tintillier, Carquefou (FR); Francois Clunet, Nantes (FR); Serge Chacun, Geneston (FR)

(73) Assignee: GEA Batignolles Technologies Thermiques, Nantes (FR)

( * ) Notice: Subject to any disclaimer, the term of this patent is extended or adjusted under 35 U.S.C. 154(b) by 684 days.

(21) Appl. No.: 12/463,861

(22) Filed: May 11, 2009

(65) Prior Publication Data

US 2010/0155041 A1 Jun. 24, 2010

(30) Foreign Application Priority Data

Dec. 19, 2008 (FR) ..... 08 58864

(51) Int. Cl.
*F28F 13/02* (2006.01)
*F28F 1/36* (2006.01)

(52) U.S. Cl. ..... 165/146; 165/181; 165/184

(58) Field of Classification Search ..... 165/146, 165/151, 181, 183, 184
See application file for complete search history.

(56) References Cited

U.S. PATENT DOCUMENTS

| | | | | | |
|---|---|---|---|---|---|
| 1,887,036 | A | * | 11/1932 | Modine | 165/181 |
| 2,006,649 | A | * | 7/1935 | Modine | 165/146 |
| 2,032,065 | A | * | 2/1936 | Modine | 165/181 |
| 2,055,549 | A | * | 9/1936 | Modine | 165/146 |
| 2,189,652 | A | * | 2/1940 | Lehman | 165/151 |
| 2,722,403 | A | * | 11/1955 | Guerra et al. | 165/181 |
| 3,515,207 | A | * | 6/1970 | Lu | 165/151 |
| 5,038,470 | A | * | 8/1991 | Dierbeck | 165/109.1 |
| 5,337,807 | A | * | 8/1994 | Ryan | 165/146 |
| 5,377,746 | A | * | 1/1995 | Reid et al. | 165/184 |
| 6,349,761 | B1 | * | 2/2002 | Liu et al. | 165/151 |
| 7,743,821 | B2 | * | 6/2010 | Bunker et al. | 165/181 |
| 2008/0023180 | A1 | | 1/2008 | Bunker | |

FOREIGN PATENT DOCUMENTS

| | | | | |
|---|---|---|---|---|
| JP | 58158494 | A | * | 9/1983 |
| JP | 59210296 | A | | 11/1984 |
| JP | 60082786 | A | | 5/1985 |
| JP | 60082787 | A | | 5/1985 |
| JP | 63003187 | A | * | 1/1988 |
| JP | 63259393 | A | * | 10/1988 |
| JP | 63263395 | A | | 10/1988 |
| JP | 08028897 | A | | 2/1996 |
| JP | 200793073 | A | | 4/2007 |
| KR | 19990065366 | | | 8/1999 |

OTHER PUBLICATIONS

Office Action for Korean Patent Application No. 2009-7020333 dated Mar. 6, 2012, with English translation.
Office Action for Korean Patent Application No. 2009-7020333 dated Dec. 21, 2011 with English translation.

* cited by examiner

*Primary Examiner* — Leonard R Leo
(74) *Attorney, Agent, or Firm* — Sughrue Mion, PLLC

(57) ABSTRACT

Tube heat exchanger comprising finned tubes, wherein the tubes extend in a certain axial direction and are provided with heat exchange fins. Each fin has a heat exchange surface surrounding a tube that extends in a certain radial direction in relation to the tube and which is relief structured to form grooves spaced apart from one another in said radial direction. The grooves of a fin have different dimensions that decrease on moving away from the tube in said radial direction so as to form a guide for a fluid around the tube.

6 Claims, 2 Drawing Sheets

HEAT EXCHANGER COMPRISING TUBES WITH GROOVED FINS

FIELD OF THE INVENTION

The invention relates to a tube heat exchanger comprising finned tubes, wherein the tubes extend in a certain axial direction and are provided with heat exchange fins, each fin having a heat exchange surface surrounding a tube that extends in a certain radial direction in relation to the tube and which is relief structured to form grooves spaced apart from one another in said radial direction.

More specifically, the invention applies to a tube heat exchanger employing air as secondary exchange fluid such as an air cooling, air condensing, air heating or air evaporating type equipment, used respectively for cooling, condensing, heating and evaporating a fluid, particularly in refining processes, gas treatment and compression plants, gas liquefaction units, coal and gas synthesis units, electricity production installations, regasification units, or any other fluid treatment installation.

PRIOR ART

Generally speaking, such equipment comprises a main heat exchanger provided with a bundle of tubes with external fins in which the fluid to be cooled, condensed, heated or evaporated circulates, as well as manifolds for distributing and dividing up the fluid between the tubes. In particular, the cooling of the fluid takes place in the external finned tubes through heat exchange with a second fluid circulating around the tubes and external fins, particularly ambient air. To do this, a forced circulation or ventilation of ambient air is assured by fans positioned either below (which is known as forced draft) or above (which is known as induced draft) the tubes of the exchanger.

In general, the ambient air flows through the bundle of finned tubes at a relatively low face velocity of between 1.5 and 4 meters per second (m/s). At such velocities and for the geometric configurations considered (particularly air passage sections, space between two fins or two consecutive tubes), the flow regime of the ambient air is overall laminar with some local turbulences, which is characterized by relatively low heat exchanges with the external fins. The areas of the exchanger where the heat exchanges are the highest are the leading edges of the fins and the tubes in the direction of the air flow. Thus, due to the structure of the flow and the exchanger, the areas of the tubes located at the rear of the tubes in the direction of the air flow are practically unexploited for the heat exchange. Said areas, known as recirculation zones, of the exchanger are characterized by a recirculation of the air, which generates pressure drops and which does not enable a good cooling of the fin.

Patent document US-2008023180 discloses a fin for air cooled tube that has on its surface a relief with dimples or grooves formed by mechanical deformation of the fins. Such recesses or grooves make it possible to increase the heat exchange between the air and the fin thanks to the creation of turbulences while increasing the pressure drops. In particular, concentric grooves 42, of semi-cylindrical section, are formed on each fin.

Patent document WO 2007/147754 also discloses a fin for heat exchanger tube equipped with air flow deflectors in the form of protruding surfaces that modify the structure of the air flow in order to improve the heat exchanges between the air and the fin. Said surfaces are in the form of rectangular or triangular cut outs in the fin. However, since heat exchangers are usually outside and since the ambient air is not filtered, the cut outs formed in the fin may act as sources of fouling due to dust, insects, etc., which obstruct the cut outs.

BRIEF SUMMARY OF THE INVENTION

The aim of the invention is to propose a grooved fin structure for heat exchanger tube that makes it possible to obtain an increase in heat exchanges between the air and the fluid circulating in the tube, without deteriorating the pressure drop.

To this end, the invention provides a tube heat exchanger comprising finned tubes, wherein the tubes extend in a certain axial direction and are provided with heat exchange fins, each fin having a heat exchange surface surrounding a tube that extends in a certain radial direction in relation to the tube and which is relief structured to form grooves spaced apart from one another in said radial direction, and wherein the grooves of a fin have different dimensions that decrease on moving away from the tube in said radial direction so as to form a guide for a fluid around the tube.

The main advantage of such a tiered conformation of the relief of the fins is that it makes it possible to better guide the flow of air to the rear of the tubes in the radial direction of the tubes (in the direction of the flow that arrives on the tubes). By using tubes with external fins according to the invention, it is thereby possible to considerably reduce a recirculation zone of the air to the rear of the tubes in the direction of the air flow, normally considerable when finned tubes without relief (flat profile) are used. Thus, the tiered relief surface guiding the air to the rear of the tubes makes it possible to reduce the recirculation zones where the heat exchange is poor and thus to take better advantage of the surface of the fins. In this way, with a fin according to the invention, the gain obtained in terms of thermal performance can be very significant.

The invention extends to a tube heat exchanger comprising finned tubes, wherein the tubes extend in a certain axial direction and are each provided with a heat exchange fin wound in a helicoidal manner around the tube, each fin having a heat exchange surface surrounding a tube that extends in a certain radial direction in relation to the tube and which is relief structured to form grooves spaced apart from each other in said radial direction, and wherein the grooves of a fin have different dimensions that decrease on moving away from the tube in said radial direction so as to form a guide for a fluid around the tube.

The invention also extends to a tube heat exchanger comprising finned tubes, wherein the tubes extend in a certain axial direction and are each provided with fins in the form of discs, each fin having a heat exchange surface surrounding a tube that extends in a certain radial direction in relation to the tube and which is relief structured to form grooves spaced apart from each other in said radial direction, and wherein the grooves of a fin have different dimensions that decrease on moving away from the tube in said radial direction so as to form a guide for a fluid around the tube.

Preferably, the concentric grooves are formed by deformation of the material in its thickness and have a depth and a width that decrease from the axis of the tube towards the peripheral edge of the fin.

BRIEF DESCRIPTION OF THE DRAWINGS

The present invention will be better understood and other advantages will become apparent upon reading the following detailed description of several embodiments given by way of non-limiting examples and illustrated by the accompanying drawings in which.

DETAILED DESCRIPTION OF THE INVENTION

Figure 1:
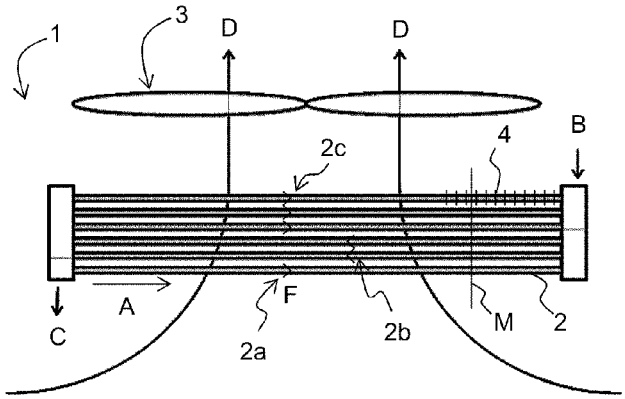
FIG. 1 schematically shows a heat exchanger in section.

In FIG. 1, a heat exchanger 1 has been represented comprising a bundle of tubes 2 of circular section with fins arranged in several substantially parallel superimposed rows extending in an axial direction A in which a fluid to be cooled circulates between an inlet B and an outlet C of the fluid, and around which circulates a flow of drafted ambient air drawn from the bottom upwards in the direction indicated by the arrows D, in a transversal manner to the tubes 2, by fans 3 positioned above the heat exchanger 1. The circulation of the fluid is here divided up into three successive passage sections or passes 2*a*, 2*b*,2*c* schematically represented in FIG. 1, which makes it possible to improve the cooling of the fluid. A heat exchanger 1 thus generally comprises between three and eight rows of superimposed tubes 2 laid out in a staggered manner or aligned in relation to the direction of circulation of the fluid in the tubes 2 as indicated by the arrows F.

The tubes 2 are provided with external radial annular fins 4 substantially perpendicular to the tube 2 and substantially parallel to each other favoring heat exchange between the ambient air and the fluid, as well as guiding the flow of air towards the rear of the tubes 2 in the axial direction, as will be described hereafter. Generally speaking, the external fins 4 make it possible to increase the external heat exchange surface by a factor of between 15 and 25 compared to the surface of a similar tube 2 without fins. Such a surface increase makes it possible to increase the heat exchange, but also generates pressure drops, which are in particular compensated by the use of efficient fans 3.

For better clarity, in FIG. 1 are shown several fins 4 spaced apart from each other on a tube 2, it is obvious that the fins 4 are arranged preferably along the whole length of all of the tubes 2 of the exchanger 1. Moreover, the shape and the dimension of the external fins 4 may vary from one tube to the next of the bundle of tubes 2. The configurations of tubes 2 with external fins 4 are not necessarily uniform within a bundle of tubes 2, particularly the diameters of the tubes 2 can vary.

Figure 2:
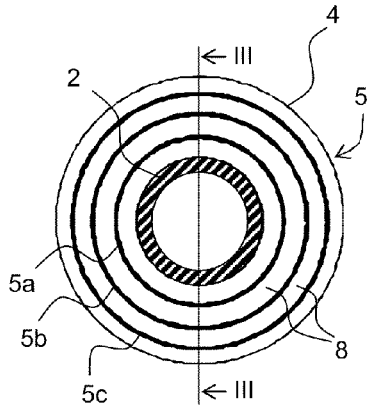
FIG. 2 is a top view of a fin according to the invention.

FIG. 2 shows, around a tube 2, a fin 4 according to the invention with a radial surface relief 5 structured to form grooves 5*a*,5*b*,5*c* spaced apart from each other in a certain radial direction E by a portion of substantially flat annular fin 8. The grooves 5*a*,5*b*,5*c* of the fin 4 have different dimensions that decrease on moving away from the tube 2 so as to form a guide for the flow of ambient air around the tube 2 in the axial direction A. More specifically, the grooves 5*a*,5*b*,5*c* of a fin 4 respectively have different respective depths p1,p2,p3 in the axial direction A and different respective widths 11,12,13 in the radial direction E, the width and the depth of the grooves decreasing on moving away from the tube 2, from an inner edge 4*b* of the fin 4 fixed to the tube 2 towards a free outer peripheral edge 4*a* of the fin 4. As may be more clearly seen in FIG. 3, the innermost groove 5*a* is the highest and the widest of the grooves, whereas the outermost groove 5*c* is the lowest and the narrowest while the middle groove 5*b* is of intermediate height and width.

Figure 3:
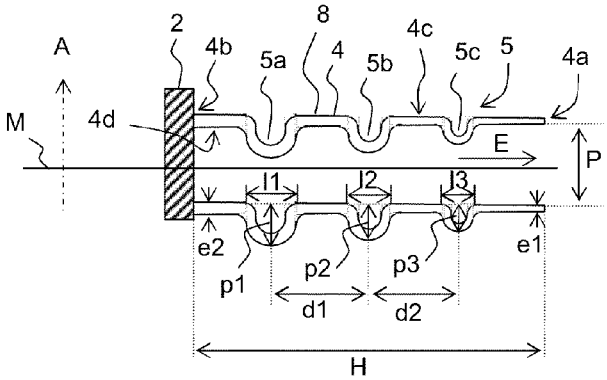
FIG. 3 is a partial radial section view along the axis III-III of FIG. 2 of a tube with two fins according to the invention.

Preferably, the number of grooves 5*a*,5*b*,5*c* on a fin 4 is between two and four, but other grooves may be added depending on the application. In FIG. 3, the surface in relief 5 is constituted of three circular grooves 5*a*,5*b*,5*c* laid out according to a concentric shaped pattern and centered around the tube 2. Adjacent fins 4 may have concentric grooves 5*a*,5*b*,5*c* that are respectively in axial alignment (the fins 4 have a same surface in relief 5 and thus a groove 5*a*,5*b*,5*c* of one fin 4 is in axial alignment with the corresponding groove of the other fins 4 on the tube 2). In FIG. 3, the concentric adjacent grooves 5*a*,5*b*,5*c* of a fin 4 are separated (disjointed) in a radial manner from each other by flat annular portions 8 of fin. Said annular portions 8 may have in the radial direction E a same width d1,d2 or different widths d1,d2 according to a variable pattern, d1,d2 being for example between 1 and 5 mm. For example, the widths of portions decrease in going from the tube 2 towards the outer peripheral edge 4A or conversely. Adjacent grooves may also be provided that are joined at their bases and in this case, the width of the separation portions 8 is very small (less than 1 mm).

For simplicity of manufacture, a tube 2 has fins 4 of the same configuration over its whole length. But in a heat exchanger 1, tubes 2 may be provided with different configurations of fins 4. For example, it is possible to have a tube 2 in which the fins 4 have adjacent grooves 5*a*,5*b*,5*c* in which the widths d1,d2 of separation portion 8 increase towards the outer peripheral edge 4A, and an adjacent tube 2 in which the fins 4 have adjacent grooves 5*a*,5*b*,5*c* in which the widths d1,d2 of separation portion 8 conversely decrease towards the outer peripheral edge 4A.

Figure 4:
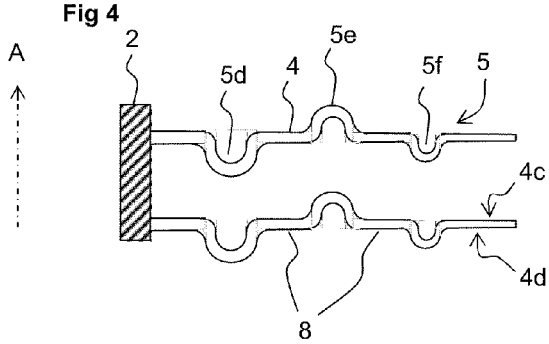
FIG. 4 is a partial radial section view along the axis III-III of FIG. 2 of a tube with two fins according to the invention in another embodiment.

On the fin 4 of FIG. 3, the grooves 5*a*,5*b*,5*c* are formed on a same face 4*c* of the fin 4, in other words oriented in the same direction in relation to the fin 4. FIG. 4 shows another embodiment of a fin 4 according to the invention wherein grooves 5*d*,5*e*,5*f* are oriented on either side of the fin 4, in other words that they are arranged in alternation on two opposite faces 4*c*,4*d* of the fin 4, which may confer a better mechanical strength compared to the grooves 5*a*,5*b*,5*c*.

Figure 5:
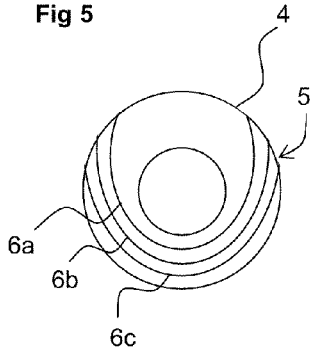
FIG. 5 is a top view of a fin according to the invention in yet another embodiment.

FIG. 5 shows another embodiment of a fin 4 according to the invention wherein the concentric grooves 5*a*,5*b*,5*c* have been replaced by grooves 6*a*,6*b*,6*c* laid out according to an elliptical shaped pattern 4. Such elliptical grooves 6*a*,6*b*,6*c* make it possible to take better advantage of the phenomenon of guiding the air by the grooves while limiting the associated increase in pressure drop. The advantage of this solution is an increase in the gain in performance for similar conditions of use, in other words constant velocity and same pressure drop.

Figure 6:
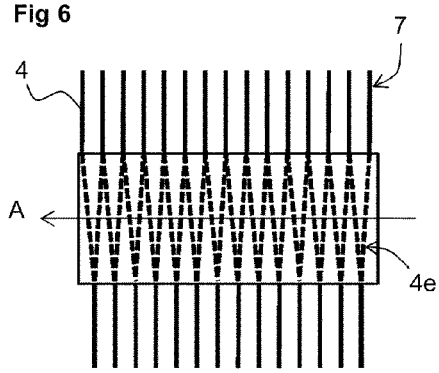
FIG. 6 is a radial section view along the axis III-III of FIG. 2 of a tube provided with several fins according to the invention.

The external fins 4 may be produced from a strip 7 made of aluminum, or instead another heat conducting material, wound in a helicoidal manner in the axial direction A around each tube 2, as schematically represented in FIG. 6. It should be noted that the fins 4 are here very slightly inclined in relation to the tube 2 and the direction A, as indicated by the arrow 4*e*, this inclination being low on account of the fact that the fins 4 are very close to each other, so that it may be considered that the fins 4 are virtually perpendicular to the tube 2. A tube 2 may also be formed with fins 4 more inclined in relation to the axial direction A of the tube 2. Another means of forming an external fin 4 is forming by means of a series of discs in rotation. The attachment between the fin 4 and the tube 2 may be achieved either by embedding the fin 4 for example in a groove formed beforehand on the periphery of the tube 2 (not represented), or by winding the fin 4 at the base of which a folding is carried out then crimping on the tube 2 for example knurled. The fin 4 may also be obtained by forming or deformation of an added-on aluminum tube that covers the tube 2. The fin 4 may also be formed by means of stacked discs.

As may be seen in FIG. 3, the fin 4 has a thickness that decreases on moving away from the tube from the inner edge 4*b* of the fin 4 towards its outer edge 4*a*. Advantageously, the thickness e1 of the fin 4 at its outer edge 4*a* may be between around 0.15 and 0.4 millimeters (mm) and the thickness e2 of the fin 4 at its inner edge 4*b* may be between around 0.4 and 1 mm.

The grooves 5*a*,5*b*,5*c* have respective depths p1,p2,p3 between around 0.4 and 1.5 mm, and respective widths l1,l2, l3 at the base of the groove between around 1 and 4 mm, the grooves 5*a*,5*b*,5*c* having different heights and widths so as to obtain the tiered relief decreasing on moving away from the tube 2 such that p1>p2>p3 and l1>l2>l3.

The fin 4 according to the invention has a length H between around 10 and 20 mm and preferentially between around 12 and 18 mm. The step P between two consecutive fins along the tube 2 is between around 2.2 and 3.5 mm and preferentially between around 2.5 and 3.2 mm, or generally less than the conventional spacing between two consecutive flat profile fins.

Generally, a heat exchanger 1 comprises a bundle of tubes 2 supported by a steel structure (not shown) and formed of around 50 to 300 tubes 2 of diameter between around 15 millimeters and 55 millimeters, the width of the heat exchanger 1 being between 0.3 meters and 5 meters, and its length between 8 meters and 18 meters.

The tubes 2 may be composed of steel, for example stainless steel or carbon steel or a highly alloyed steel, such as Incoloy, the choice of the material of the tubes 2 being dependent on the transported fluid, which may be aggressive, and the operating conditions. The external fins 4 are generally made of aluminum, but can also be made of stainless steel, or any other heat conducting material.

Figure 7:
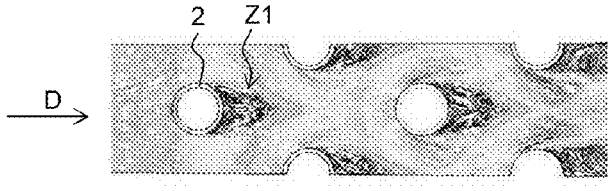
FIG. 7 is a radial section view of a series of tubes with flat profile fins showing stream lines in a plane between two fins obtained by digital simulation.
Figure 8:
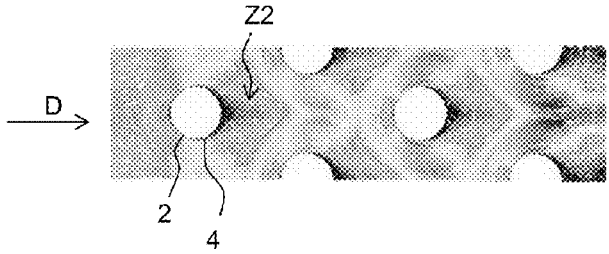
FIG. 8 is a radial section view of a series of tubes with fins according to the invention showing stream lines obtained by digital simulation.

FIGS. 7 and 8 show stream lines (obtained by digital simulation) of the ambient air circulating in the direction D around several tubes 2 of the heat exchanger 1 in a plane M substantially perpendicular to the tubes 2 and situated at the centre between two consecutive fins 4 as indicated in FIG. 1 and in FIG. 3. More specifically, FIG. 7 shows the case of a flat profile fin and FIG. 8 shows the case of a fin 4 according to the invention comprising concentric grooves 5*a*,5*b*,5*c*. As may be seen in FIG. 7 a fluid recirculation zone Z1 is located to the rear of the tubes 2 in the direction of the flow D of air in which the heat exchange is poor. On the other hand, as may be seen in FIG. 8, a very considerable decrease may be noted in the recirculation of the fluid in a zone Z2 located to the rear of the tubes 2 in the direction of the flow D of the air. This is due to the grooves 5*a*,5*b*,5*c* of the fins 4, which guide the flow of air towards the rear of the tubes 2 in the axial direction, making it possible to reduce the zones where the heat exchange is poor and thus to take better advantage of the fins 4.

Figure 9:
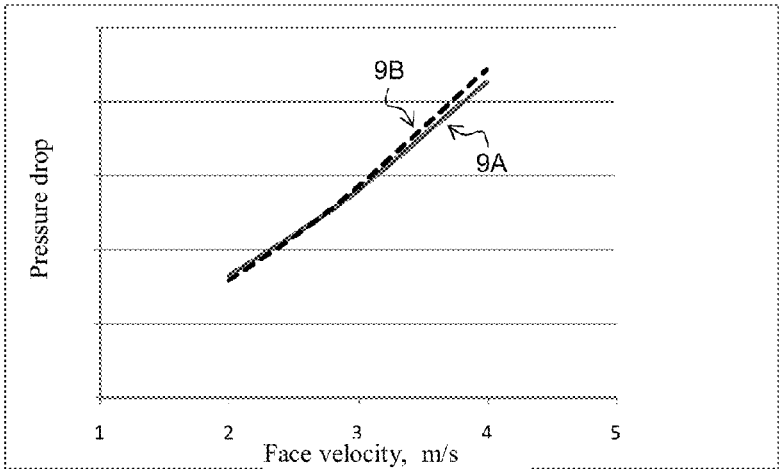
FIG. 9 schematically represents a graph representative of the pressure drop as a function of the face velocity of the air arriving on a fin according to the invention and on a flat profile fin.

FIG. 9 shows the pressure drop as a function of the face velocity of the air on the tubes 2 for tubes 2 with flat profile fins (curve 9A) and for tubes 2 with fins 4 according to the invention with concentric grooves 5*a*,5*b*,5*c* (curve 9B). Generally speaking, an increase in the pressure drop is noted, which is induced by the surface in relief 5 or the grooves 5*a*,5*b*,5*c* of the fins 4. This increase in the pressure drop may be compensated by spacing the fins 4 one another along the tube 2. For these and the following calculations, the step P between two consecutive fins is thus different depending on whether the surface of the fins is in relief or not: 2.54 mm in the case of the flat profile fin and 3 mm for the fin 4 according to the invention with concentric grooves 5*a*,5*b*,5*c*. In this way, as may be seen in FIG. 9, the increase in the pressure drop induced by the surface in relief 5 remains very slight.

Figure 10:
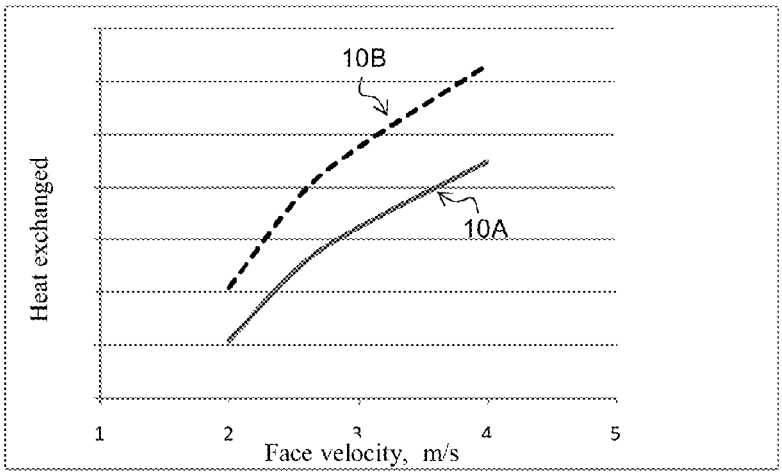
FIG. 10 schematically represents a graph representative of the heat exchanged as a function of the face velocity of the air arriving on a fin according to the invention and on a flat profile fin.

FIG. 10 shows the heat exchanged as a function of the face velocity of the air on the tubes 2 for tubes 2 with flat profile fins (curve 10A) and for tubes 2 with fins 4 according to the invention with concentric grooves 5*a*,5*b*,5*c* (curve 10B) and for steps P between fins as defined above. The heat exchanged of the heat exchanger 1, in other words the gain obtained, increases by around 10 to 25% according to the face velocity of the air, which corresponds to a performance increase per unit of exchanger length between 2 and 10%.

Furthermore, the spacing of the fins 4 along the tube 2 makes it possible to reduce the amount of material used to form the fins, which compensates the increase in material brought about by the formation of the surface in relief 5 on the fin 4 through modification of the surface of the fin, and reduces the amount of material used to achieve a saving of around 3 to 6% per meter.

The invention claimed is:

1. A tube heat exchanger comprising finned tubes, wherein the tubes extend in a certain axial direction and are provided with at least one heat exchange fin wound in a helicoidal manner around the tube, each fin having a heat exchange surface surrounding a tube that extends in a certain radial direction in relation to the tube and which is relief structured to form grooves spaced apart from one another in said radial direction, and wherein the grooves of a fin have different depths and widths that decrease on moving away from the tube in said radial direction so as to form a guide for a fluid around the tube.

2. A heat exchanger according to claim 1, wherein each fin has a thickness that decreases on moving away from the tube in said radial direction.

3. A heat exchanger according to claim 1, wherein the grooves of a fin are spaced apart from each other according to a concentric shaped pattern.

4. A heat exchanger according to claim 1, wherein the grooves of a fin are spaced apart from each other according to an elliptical shaped pattern.

5. A heat exchanger according to claim 1, wherein the grooves of a fin are spaced apart from each other and joined at their bases.

6. A heat exchanger according to claim 1, wherein each fin has two opposite faces acting as heat exchange surface, said grooves being arranged on the two faces of the fin.

* * * * *